US010464226B2

(12) United States Patent
Bozikis et al.

(10) Patent No.: US 10,464,226 B2
(45) Date of Patent: Nov. 5, 2019

(54) SHAVING RAZORS AND SHAVING CARTRIDGES

(71) Applicant: BIC VIOLEX S.A., Anixi (GR)

(72) Inventors: Ioannis Bozikis, Koukaki-Athens (GR); Spiros Gratsias, Kypseli-Athens (GR); Christoforos-Athanasios Brellis, Neapoli-Athens (GR); Panagiotis Moustakas, Petroupoli-Athens (GR)

(73) Assignee: BIC VIOLEX S.A., Anixi (GR)

( * ) Notice: Subject to any disclaimer, the term of this patent is extended or adjusted under 35 U.S.C. 154(b) by 0 days.

(21) Appl. No.: 15/392,247

(22) Filed: Dec. 28, 2016

(65) Prior Publication Data

US 2017/0151684 A1 Jun. 1, 2017

Related U.S. Application Data

(63) Continuation of application No. 14/964,745, filed on Dec. 10, 2015, now Pat. No. 9,539,734.

(60) Provisional application No. 62/261,389, filed on Dec. 1, 2015.

(51) Int. Cl.
*B26B 21/22* (2006.01)
*B26B 21/40* (2006.01)

(52) U.S. Cl.
CPC ..... *B26B 21/227* (2013.01); *B26B 21/4012* (2013.01); *B26B 21/4068* (2013.01)

(58) Field of Classification Search
CPC ..... Y10T 24/44043; Y10T 24/4406; B26B 21/227; B26B 21/4012; B26B 21/16; B26B 21/165; B26B 21/02; B26B 21/06; B26B 21/222; B26B 21/4068; B26B 21/4075
USPC ..... 30/47–51, 62–68
See application file for complete search history.

(56) References Cited

U.S. PATENT DOCUMENTS 816,195 A * 3/1906 Turner ..... B26B 21/16 30/531
987,743 A * 3/1911 Ragsdale ..... B26B 21/16 30/66
1,455,726 A * 5/1923 Hartman ..... B26B 21/52 30/529
3,821,851 A * 7/1974 Kuhnl ..... B26B 21/24 30/40.2
5,671,534 A * 9/1997 Mayerovitch ..... B26B 21/44 30/41
6,035,537 A * 3/2000 Apprille, Jr. ..... B26B 21/227 30/346.5
6,145,201 A * 11/2000 Andrews ..... B26B 21/22 30/34.05

(Continued)

OTHER PUBLICATIONS

Complete the written description of US Pat. No. 3,821,851 to Kuhnl obtained from http://patft.uspto.gov/.*

*Primary Examiner* — Evan H MacFarlane
(74) *Attorney, Agent, or Firm* — Polsinelli PC

(57) ABSTRACT

A shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, and a pair of retainers each having a top portion, a bottom portion, and a portion connecting the top portion to the bottom portion, the retainers extending along the pair of side edges between the front edge of the housing and the rear edge of the housing.

23 Claims, 9 Drawing Sheets

(56) References Cited

U.S. PATENT DOCUMENTS

| | | | | |
|---|---|---|---|---|
| 8,286,354 | B2 * | 10/2012 | Walker, Jr. | B26B 21/225 30/32 |
| 9,539,734 | B1 * | 1/2017 | Bozikis | B26B 21/227 |
| 2010/0077619 | A1 * | 4/2010 | Folio | B26B 21/225 30/50 |
| 2014/0230251 | A1 * | 8/2014 | Hage | B26B 21/521 30/41 |
| 2015/0090085 | A1 * | 4/2015 | Griffin | B26B 21/4018 83/13 |

* cited by examiner

SHAVING RAZORS AND SHAVING CARTRIDGES

CROSS-REFERENCE TO RELATED APPLICATIONS

This application is a Continuation of U.S. patent application Ser. No. 14/964,745, filed Dec. 10, 2015, which claims the benefit of U.S. Provisional Application No. 62/261,389, filed Dec. 1, 2015, which is hereby incorporated by reference in its entirety for all purposes.

STATEMENT REGARDING FEDERALLY SPONSORED RESEARCH OR DEVELOPMENT

Not applicable.

BACKGROUND OF THE INVENTION

1. Field of the Invention

The following description relates to shaving razors and shaving cartridges. A shaving razor or shaving cartridge may include one or more blades and one or more retainers for retaining elements of the shaving razor or shaving cartridge. For example, a pair of c-shaped retainers extending along a pair of side edges of the shaving cartridge retains the blades in position within the housing.

2. Description of Related Art

Typically, a conventional razor head includes one or more razor blades secured to a razor head housing. A number of different securing mechanisms are typically used for securing razor blades. Such conventional mechanisms include clip retaining elements that wrap around the front and rear edges of a razor head housing and clip retaining elements that extend through one or more pairs of apertures adjacent to the front and rear ends of the housing.

For example, U.S. Pat. No. 6,035,537 describes a pair of clips that wrap around the front and rear ends of a razor housing for securing blades within the housing. U.S. Pat. No. 8,286,354 describes a razor head including two pairs of apertures formed in the body of the razor cartridge for receiving a pair of clips to retain the razor blades within the housing. U.S. Patent Application Publication No. 2015/0090085 describes a razor head including a pair of apertures and a pair of clips that extend through the pair of apertures on one end and wrap around the housing on the other end. U.S. Patent Application Publication No. 2010/0077619 describes a unitary retainer element that wraps around three sides of a cartridge frame with a plurality of tabs at either end that wrap around ends of the cartridge frame and extend into apertures in the cartridge frame to provide structural stability to the cartridge frame.

FIGS. 11A-11B are diagrams illustrating a prior art shaving cartridge. Referring to FIGS. 11A-11B a conventional razor cartridge 10 includes a pair of clips 15 that extend through apertures formed on both ends of the razor cartridge. The clips 15 extend over the razor blades from a front edge of the housing adjacent to a guard bar to a rear edge of the housing adjacent to the cap.

Several disadvantages are typically encountered in the use and manufacture of conventional razor cartridges such as the razor cartridge 10 illustrated in FIGS. 11A-11B. During the manufacturing process, clips 15 may encounter buckling as a result of the force that is applied in bending the legs of the clips 15. As a result of the bending force exerted on the clips 15, the clips 15 have a tendency to buckle upwards. Therefore, the blade exposures may be unstable throughout the razor cartridge 10 and may vary significantly from the intended blade exposure values.

Also, during the manufacturing of the razor cartridge 10, one or more legs of the clips 15 may fail to be bent. That is, after manufacturing of the razor cartridge 10 is completed, additional attention and labor may be required to ensure that all the clips are properly secured and all the clip legs are properly bent beneath the housing of the razor cartridge 10. Where a clip leg is not secured, additional steps are required to bend the clip leg beneath the housing.

Further, manufacturing of the razor cartridge 10 is a multi-step process that typically includes providing clips 15 having specific dimensions and materials that may require use of a third party vendor for manufacture and/or supply, positioning the clips 15 at the proper position, placing the clip legs through one or more pairs of apertures or wrapping the clip legs around the housing, and bending the clip legs after securing the clips 15 to the one or more pairs of apertures. This manufacturing process is timely and costly, and typically requires multiple steps and a third party manufacturer and vendor.

It should also be appreciated that the razor cartridge 10 including the clips 15 provides a variable retaining force throughout the length of the clips 15. Because the clips are secured 15 to the razor cartridge 10 at only the front and rear ends thereof, the retaining forces throughout the length of the clips 15 is variable.

SUMMARY OF THE INVENTION

In an embodiment of the present invention, a shaving blade unit includes a housing having a top surface, a bottom surface, a front edge, a rear edge, and a pair of side edges extending between the front edge and the rear edge, the housing having at least one blade disposed between the front edge and the rear edge, the at least one blade having a cutting edge, and a pair of substantially c-shaped retainers each having a top portion, a bottom portion, a substantially convex portion connecting the top portion to the bottom portion, the retainers extending along the pair of side edges between the front edge of the housing and the rear edge of the housing, where the top portion of each of the retainers is substantially planar and the bottom portion of each of the retainers is curved.

In another embodiment of the present invention, a shaving blade unit includes a housing and/or a retainer. The housing may include (i) a pair of longitudinal sides, (ii) a pair of lateral sides extending between the pair of longitudinal side, and/or (iii) at least one blade disposed at least partially within the housing and extending longitudinally along at least a portion of the pair of longitudinal sides. The retainer may be secured to each of the pair of lateral sides of the housing. Each of the retainers may include a substantially planar top portion, a substantially non-planar bottom portion, and/or a substantially non-planar intermediate portion connecting the top portion to the bottom portion. The top portion and the intermediate portion of each of the retainers may be curved around a portion of one of the pair of lateral sides of the housing.

The top portion and/or the intermediate portion of each of the retainers may have a substantially continuous curvature. Each of the retainers may include a protrusion depending from the top portion, and/or a recess extending into the top portion. The recess and/or the protrusion may be formed on opposite surfaces of the top portion of each of the retainers. Each of the pair of lateral sides of the housing may include a receiver. Each of the receivers may be operable to receive at least a portion of one of the protrusions.

Each of the retainers may have an installed configuration that is different than an uninstalled configuration. The uninstalled configuration may be an original configuration of each of the retainers after manufacture, but before initiating any step of an assembly or installation process of each of the retainers onto the shaving blade unit. The installed configuration may be a final configuration of each of the retainers upon completion of the installation process. The top portion and the bottom portion of each of the retainers may be further apart from each other in the installed configuration than in the uninstalled configuration.

Each of the retainers may include a front edge and/or a rear edge defined by the top portion, the bottom portion, and/or the intermediate portion. The front edge and/or the rear edge is planar. The front edge and/or the rear edge of each of the retainers may define a plane. The planes may extend parallel to each other. Each of the pair of lateral sides of the housing may include a receiver. Each of the receivers may be operable to receive a substantial portion of one of the retainers. The retainers may have an identical shape with respect to each other. Each of the retainers may be operable to be selectively and/or independently secured to any one of the pair of lateral sides. Each of the retainers may be operable to be selectively and/or independently secured to either one of the pair of lateral sides, thereby allowing each of the retainers to be substituted for one another.

In another embodiment of the present invention, a shaving blade unit includes a housing and a retainer. The housing includes (i) a pair of longitudinal sides, (ii) a pair of lateral sides extending between the pair of longitudinal side, and/or (iii) at least one blade disposed at least partially within the housing and extending longitudinally along at least a portion of the pair of longitudinal sides. The retainer may be secured to each of the pair of lateral sides of the housing. Each of the retainers may have (i) a top portion, (ii) a bottom portion, (iii) an intermediate portion connecting the top portion to the bottom portion, and/or (iv) planar front and rear edges defined by the top portion, the bottom portion, and/or the intermediate portion. The top portion and/or the intermediate portion of each of the retainers may have a substantially continuous curvature.

Each of the retainers may include a protrusion depending from the top portion, and/or a recess extending into the top portion. The recess and the protrusion may be formed on opposite surfaces of the top portion of each of the retainers. Each of the pair of lateral sides of the housing may include a receiver. Each of the receivers may be operable to receive at least a portion of one of the protrusions.

Each of the retainers may have an installed configuration that is different than an uninstalled configuration. The uninstalled configuration may be an original configuration of each of the retainers before initiating an installation process. The installed configuration may be a final configuration of each of the retainers upon completion of the installation process. The top portion and the bottom portion of each of the retainers may be further apart from each other in the installed configuration than in the uninstalled configuration.

Each of the pair of lateral sides of the housing may include a receiver. Each of the receivers may be operable to receive a substantial portion of one of the retainers. The retainers may have an identical shape. The retainers may be selectively and independently secured to any one of the pair of lateral sides.

In another embodiment of the present invention, a shaving blade unit includes a housing and a pair of retainers. The housing may include (i) a pair of longitudinal sides, (ii) a pair of lateral sides extending between the pair of longitudinal side, and/or (iii) at least one blade disposed at least partially within the housing and extending longitudinally along at least a portion of the pair of longitudinal sides. The pair of retainers may be secured to the housing. Each of retainers may (i) be secured to one of the pair of lateral sides of the housing, (ii) have an identical shape, (iii) be operable to be independently secured to either one of the pair of lateral sides, and/or (iv) substantially surround a respective one of the pair of lateral sides. The top portion and/or the intermediate portion of each of the retainers may have a substantially continuous curvature.

Each of the retainers may include a protrusion depending from the top portion, and/or a recess extending into the top portion. The recess and the protrusion may be formed on opposite surfaces of the top portion of each of the retainers. Each of the pair of lateral sides of the housing may include a receiver. Each of the receivers may be operable to receive at least a portion of one of the protrusions. Each of the retainers may include a front edge and/or a rear edge defined by the top portion, the bottom portion, and/or the intermediate portion. The front edge and/or the rear edge may be planar. The front edge and/or the rear edge of each of the retainers may define a plane. Each of the planes may extend parallel to each other. Each of the pair of lateral sides of the housing may include a receiver. Each of the receivers may be operable to receive a substantial portion of one of the retainers.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present invention is not limited to the precise embodiments and features shown. The accompanying drawings, which are incorporated in and constitute a part of this specification, illustrate an implementation of apparatuses consistent with the present invention and, together with the description, serve to explain advantages and principles consistent with the present invention.

DETAILED DESCRIPTION OF THE INVENTION

Figure 1:
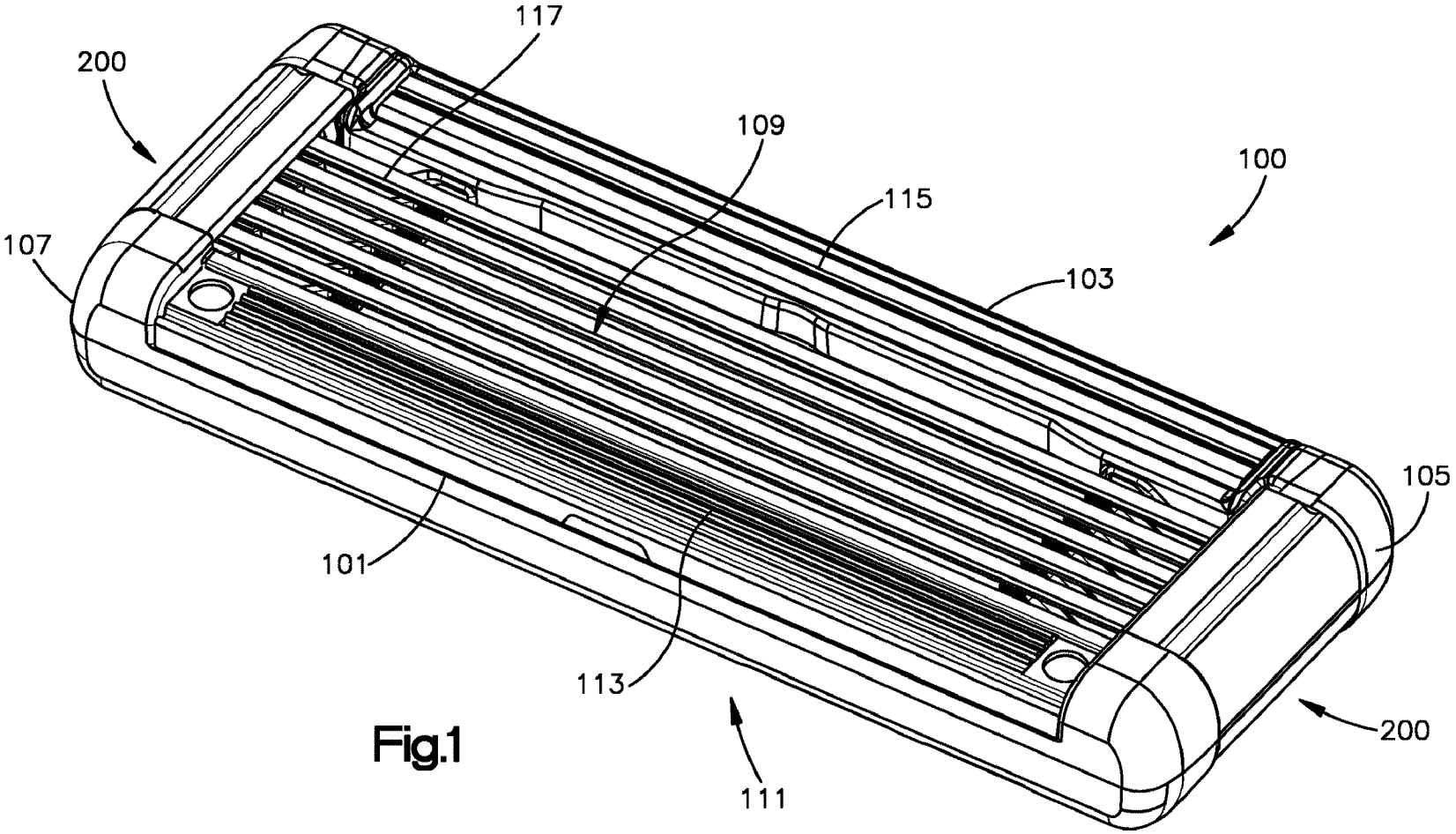
FIG. 1 is a diagram illustrating a perspective view of an example of a shaving cartridge including retainers for securing blades to the cartridge.

It is to be understood that the present invention is not limited in its application to the details of construction and to the embodiments of the components set forth in the following description or illustrated in the drawings. The figures and written description are provided to teach any person skilled in the art to make and use the inventions for which patent protection is sought. The present invention is capable of other embodiments and of being practiced and carried out in various ways. Persons of skill in the art will appreciate that the development of an actual commercial embodiment incorporating aspects of the present inventions will require numerous implementations specific decisions to achieve the developer's ultimate goal for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the figures and are not intended to limit the scope of the present invention or the appended claims. Further, it should be understood that any one of the features of the present invention may be used separately or in combination with other features. Other systems, methods, features, and advantages of the present invention will be or become apparent to one with skill in the art upon examination of the figures and the detailed description. It is intended that all such additional systems, methods, features, and advantages be included within this description, be within the scope of the present invention, and be protected by the accompanying claims.

Further, the term "substantially" as used in the description and the appended claims should be understood to include an exact or a mostly exact configuration. For example, substantially c-shaped means having an exact c-shape or a mostly exact c-shape. Also, a substantially planar surface means having an exact planar surface or a surface that is mostly planar. Similarly, a substantially nonplanar surface means having an exact nonplanar surface or a surface that is mostly nonplanar, e.g., curved. Also, the term "about" or "approximately" as used in the description and the appended claims should be understood to include the recited values or a value that is three times greater or one third of the recited values. For example, about 3 mm includes all values from 1 mm to 9 mm, and approximately 50 degrees includes all values from 16.6 degrees to 150 degrees.

It will be appreciated by those skilled in the art that changes could be made to the embodiments described above without departing from the broad inventive concept thereof. It is understood, therefore, that the present invention disclosed herein is not limited to the particular embodiments disclosed, but it is intended to cover modifications within the spirit and scope of the present invention as defined by the appended claims.

FIG. 1 is a diagram illustrating a perspective view of an example of a shaving cartridge 100 including retainers 200 for securing blades 117 to the cartridge 100.

Referring to FIG. 1, the shaving cartridge 100 includes a housing having front and rear longitudinal sides with a front edge 101 and a rear edge 103, respectively. The shaving cartridge 100 further includes a pair of lateral sides with side edges 105, 107. The shaving cartridge 100 further includes a top surface 109 and a bottom surface 111. The pair of side edges 105, 107 extend between the front edge 101 of the housing and the rear edge 103 of the housing. The shaving cartridge 100 includes a guard bar 113 adjacent to the front edge 101 of the housing and a cap 115 adjacent to the rear edge 103 of the housing. One or more blades 117 are positioned between the guard bar 113 and the cap 115, extend longitudinally along a portion of the front edge 101 and the rear edge 103 and retained in position within the housing using one or more retainers 200. In this example, the shaving cartridge 100 includes five blades 117 that are retained in position within the housing using a pair of retainers 200 but any number of blades may be used.

Figure 2:
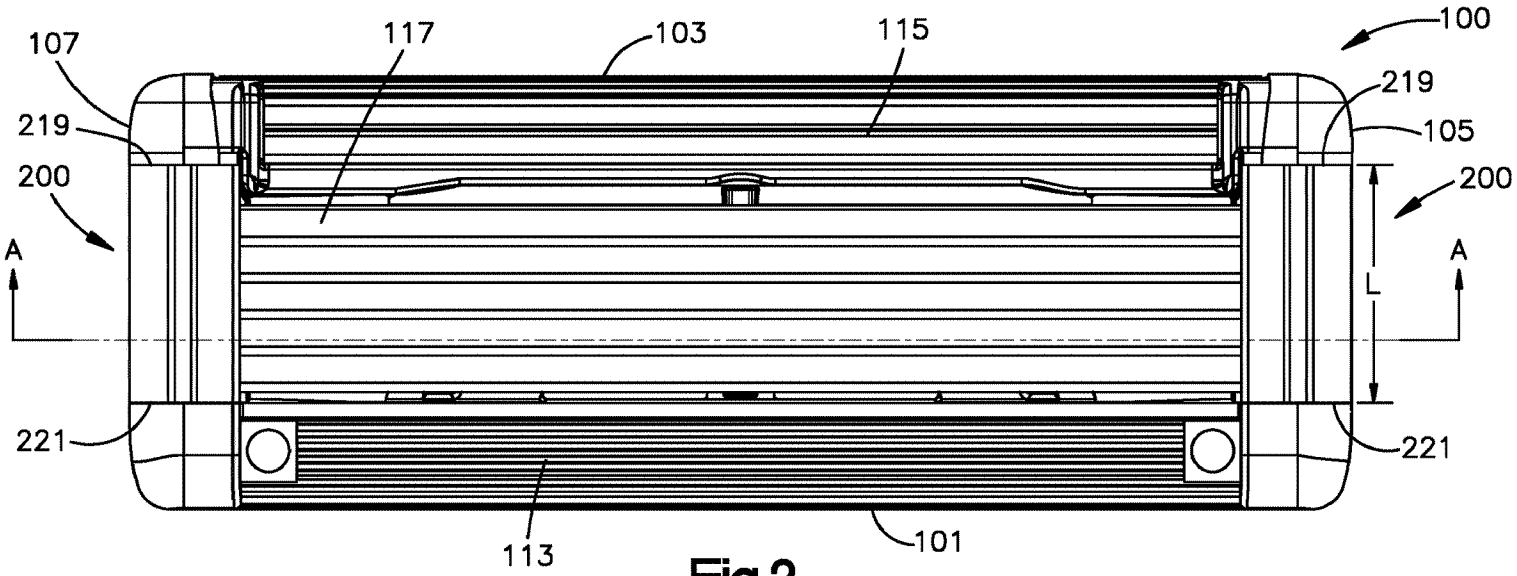
FIG. 2 is a diagram illustrating a top view of the shaving cartridge including the retainers.
Figure 3:
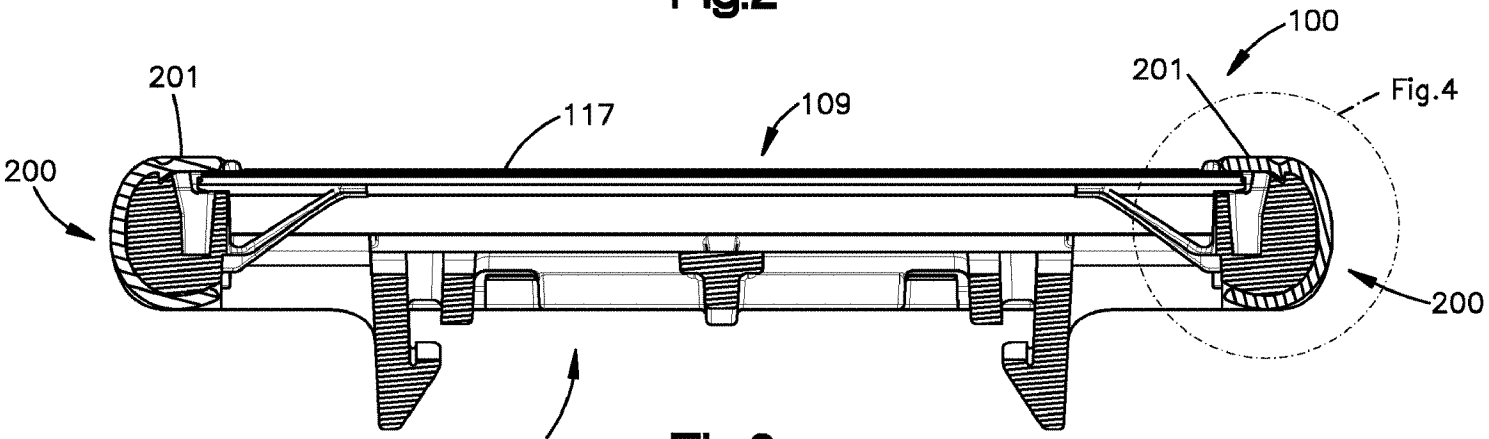
FIG. 3 is a diagram illustrating a cross-sectional view of the shaving cartridge along the line A-A shown in FIG. 2.

FIG. 2 is a diagram illustrating a top view of the shaving cartridge 100 including the retainers 200, and FIG. 3 is a diagram illustrating a cross-sectional view of the shaving cartridge 100 along the line A-A shown in FIG. 2.

Referring to FIGS. 2-3, the retainers 200 are separated from each other with no connecting element therebetween. The retainers 200 are operable to be independently positioned on opposite sides of the housing. The retainers 200 are identically sized and shaped, thereby allowing each of the retainers 200 to be substituted for one another. The retainers 200 extend along the side edges 105, 107 of the housing and include a top portion 201 that extends above the top surface 109 of the housing and above one or more blades 117 to retain the position of the blades 117 within the housing.

In this example, the retainers 200 extend laterally and along a length L on the side edges 105, 107 of about 8.5 mm; however, it should be appreciated that the retainers 200 may extend along a shorter or longer portion of the side edges 105, 107. For example, a pair of retainers 200 may each extend along the entire length, a shorter portion, or a longer portion of the side edges 105, 107. Such extensions may secure in place a guard bar, a cap element, or a trimmer assembly. Further, it should be appreciated that while this example illustrates a pair of retainers 200, any number of retainers may be used with the shaving cartridge 100. For example, a single retainer, four retainers, or any number of retainers may be used to retain the position of the blades 117 within the housing.

Figure 4:
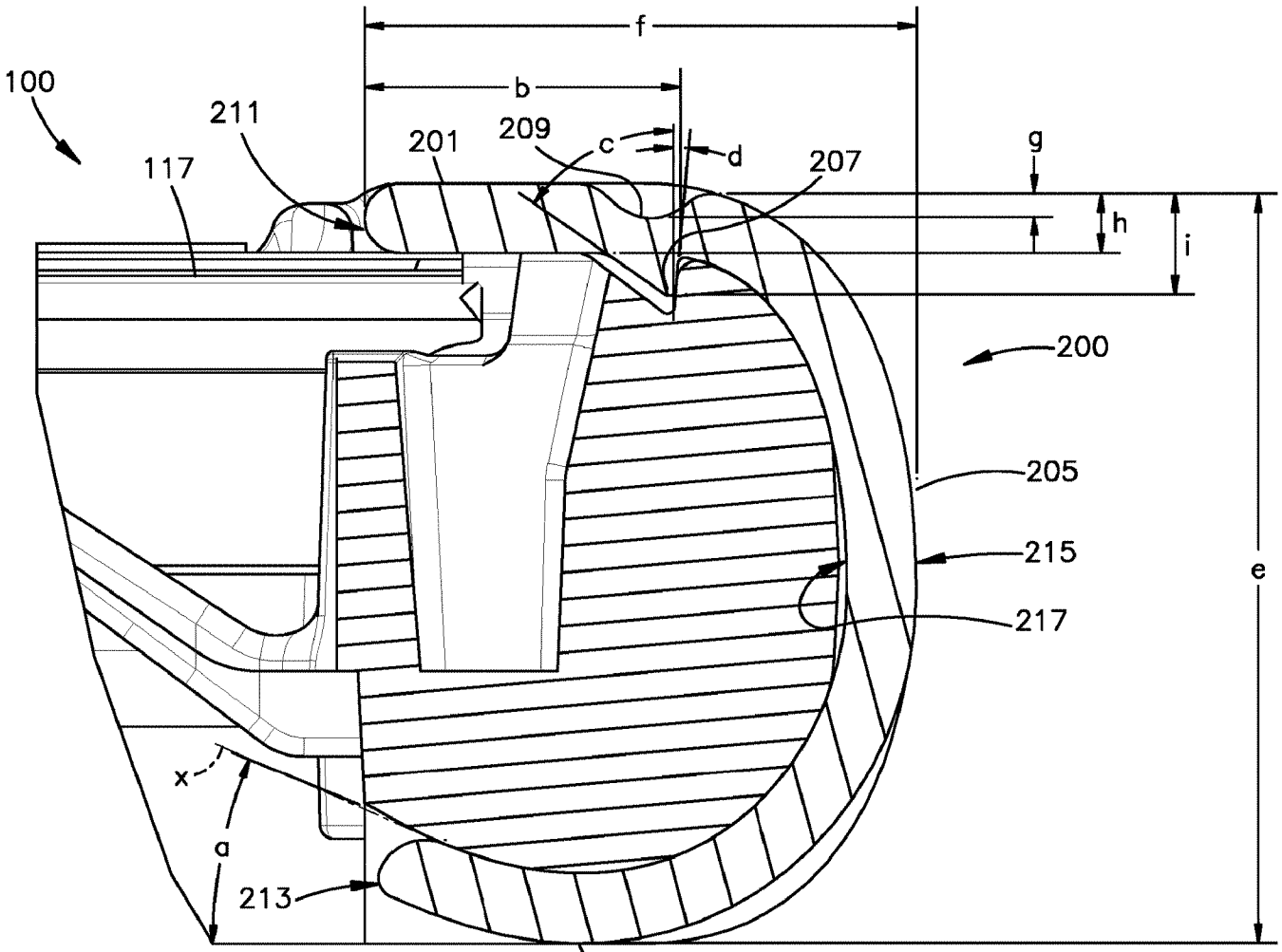
FIG. 4 is a diagram illustrating a magnified cross-sectional view of the shaving cartridge and one of the retainers in the region shown in FIG. 3.

FIG. 4 is a diagram illustrating a magnified cross-sectional view of the shaving cartridge and one of the retainers in the region shown in FIG. 3.

Referring to FIG. 4, the retainer 200 is a substantially c-shaped retainer and includes a substantially planar top portion 201, a substantially non-planar bottom portion 203, and an intermediate convex portion 205 that is substantially non-planar. The convex portion 205 connects the top portion 201 to the bottom portion 203. In addition, the retainer 200 includes a first face 211 on the top portion 201 that is facing towards the blades 117 and a second face 213 on the bottom portion 203 that is facing towards the blades 117. The inner surface 217 of the retainer 200 extends throughout the internal surface of the retainer's top portion 201, bottom portion 203, and convex portion 205, and is in contact with the housing of the cartridge 100. Similarly, the outer surface 215 of the retainer 200 extends throughout the external surface of the retainer's top portion 201, bottom portion 203, and convex portion 205. As shown in FIG. 2, each retainer 200 includes a front edge 221 that is adjacent to the guard bar 113 and a rear edge 219 that is adjacent to the cap 115.

The top portion 201 of the retainer 200 is substantially planar and secures the blades 117 to the housing. For example, the inner surface 217 of the top portion 201 of the retainer 200 is in direct contact with the edges of the blades 117 to maintain the position of the blades 117 and to maintain the blade exposure of each of the blades 117 with respect to a contact plane. The contact plane may refer to a plane that is formed on the surface of the guard bar 113 and the cap 115. It is foreseen that a cutting edge of one or more of the blades 117 may extend outside of the housing of the shaving cartridge 100 without deviating from the scope of the present inventive concept.

The bottom portion 203 is curved for securing the retainer 200 to the underside of the housing, i.e., curved around a bottom portion of each of the side edges 105, 107 of the housing. The convex portion 205 connects the top portion 201 to the bottom portion 203 and includes a curvature. In this example, the bottom portion 203 and the convex portion 205 have a substantially continuous curvature. The curvature of the bottom portion 203 and the convex portion 205 includes a plurality of radii to define the substantially continuous curvature. However, it should be appreciated that, in other examples, the convex portion 205 and/or the bottom portion 203 may include a single radius of curvature and the retainer 200 may form a semi-circular shape or the convex portion 205 and/or the bottom portion 203 may include one or more straight portions throughout its length without deviating from the scope of the present inventive concept.

Still referring to FIG. 4, the retainer 200 may include a recess 209 that is formed on and extending into the outer surface 215 of the top portion 201 of the retainer 200. Also, in this example, the retainer 200 includes a protrusion 207 that depends or extends from the inner surface 217 of the top portion 201 of the retainer. The recess 209 and the protrusion are formed on opposite surfaces of the top portion 201. The protrusion 207 is configured to be received by a corresponding receiver surface 152 on the housing that will be further described below in reference to FIGS. 5-8. The protrusion 207 further secures the retainer 200 to the housing of the cartridge 100.

In this example, the recess 209 further supports the planar stiffness of the top portion 201, and the protrusion 207 anchors the retainer 200 in a fixed position. An example process of manufacturing the retainer 200 includes forming the protrusion 207 and the recess 209 from a punch and die. The die on the inner surface 217 of the retainer 200 is in the shape of the protrusion 207, with adequate offset for stamping. The punching of the outer surface 215 of the top portion 201 creates the recess 209 on the outer surface 215 of the top portion 201, and transfers the material of the retainer 200 into the shape of the protrusion 207. The protrusion 207 thus extends from the inner surface 217 of the top portion 201 taking the shape of the die, as illustrated in FIG. 4.

In an example, the retainer 200 has a height e from the uppermost part of the top portion 201 to the lowermost part of the bottom portion 203 that is about 5.4 mm. The distance b from the innermost part of the first face 211 that is closest to the center of the housing to the tip of the protrusion 207 is about 2.2 mm, but may range from about 1 mm to about 3 mm. The distance f from the innermost part of the first face 211 that is closest to the center of the housing to the outermost part of the retainer 200 that is farthest from the center of the housing is about 4 mm but may range from about 3 mm to about 5 mm. The angle a between the horizontal line that is tangent to the lowermost point of the bottom portion 203 and the line x that is tangent to the innermost point on the inner surface of the bottom portion 203 prior to a change in the radius of curvature of the bottom portion is approximately 22 degrees. In an example, this angle is a positive angle that can range from about 0 to about 60 degrees. The value of the angle applied will drive the amount of locking interaction that is required for a specific head design. The thickness of the retainer 200 may range throughout the length of the retainer 200 with the greatest thickness h being approximately 0.5 mm.

Still referring to FIG. 4, in this example, the protrusion has a triangular shape, and the angle c between the left side of the protrusion 207 and the vertical line that is passing through the tip of the protrusion is about 55 degrees. The angle d between the outer side of the protrusion 207 and the vertical line that is passing through the tip of the protrusion is about 5 degrees. The depth i of the protrusion from the uppermost part of the top portion 201 is about 0.75 mm. The recess 209 includes a semi-circular shape and a depth g of the recess from the uppermost part of the top portion 201 is about 0.25 mm.

It should be appreciated by one of ordinary skill in the art that these dimensions and shapes are only an example of an embodiment, a number of other dimensions and shapes may be used for the retainer 200, the protrusion 207, and the recess 209. For example, while the shapes of the protrusion 207 and the recess 209 are triangular and semi-circular, respectively, the shapes of the protrusion and recess may include triangular, oblong, square, rectangular, circular, semi-circular, elliptical, or other related shapes as understood by a person of ordinary skill in the art.

Figure 5:
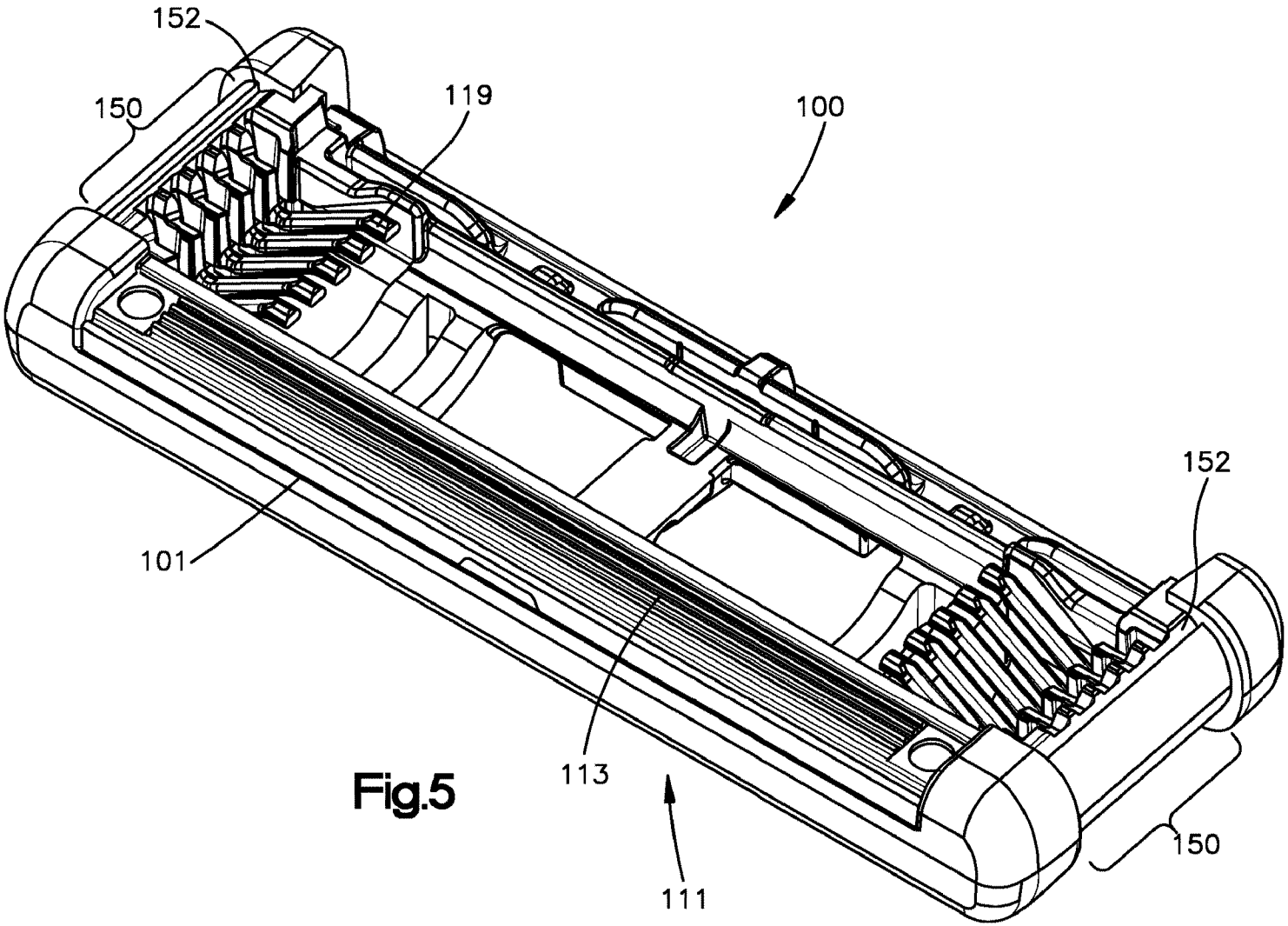
FIG. 5 is a diagram illustrating a perspective view of the shaving cartridge without the retainers.

FIG. 5 is a diagram illustrating a perspective view of the shaving cartridge without the retainers.

Referring to FIG. 5, the shaving cartridge 100 is shown with the retainers 200, the cap 115, and the blades 117 being removed. The shaving cartridge 100 may include one or more springs 119 for supporting the blades 117 and providing independently movable blades 117 within the housing. Each of the lateral sides of the shaving cartridge includes a pair of receivers or recesses 150 for receiving the pair of retainers 200 so that the pair of retainers 200 are nested therein with an outermost surface of each of the pair of retainers 200 flush with an outermost surface of the lateral sides of the shaving cartridge 100. Each recess 150 includes a corresponding surface 152 for receiving the protrusion 207 of the retainer 200. In an example, the recesses 150 may extend along the same length L as the retainers 200 of about 8.5 mm; however, it should be appreciated that a variety of different lengths may be used. In addition, the recess 150 may have a different length than the retainer 200.

Figure 6:
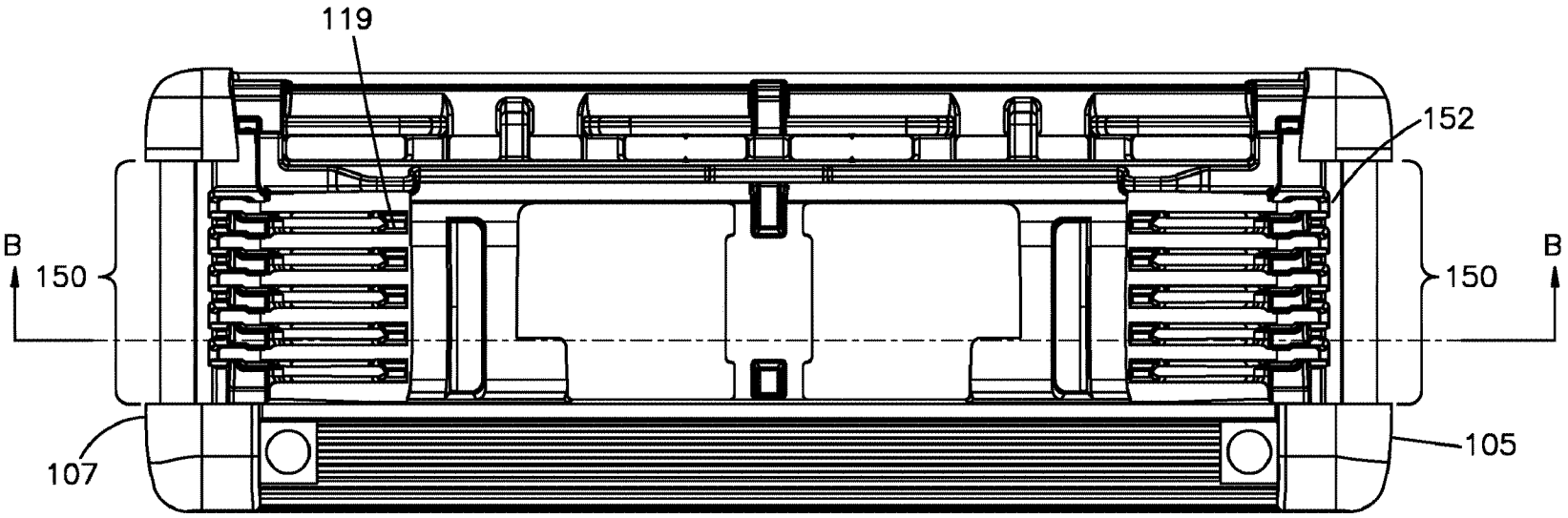
FIG. 6 is a diagram illustrating a top view of the shaving cartridge without the retainers.
Figure 7:
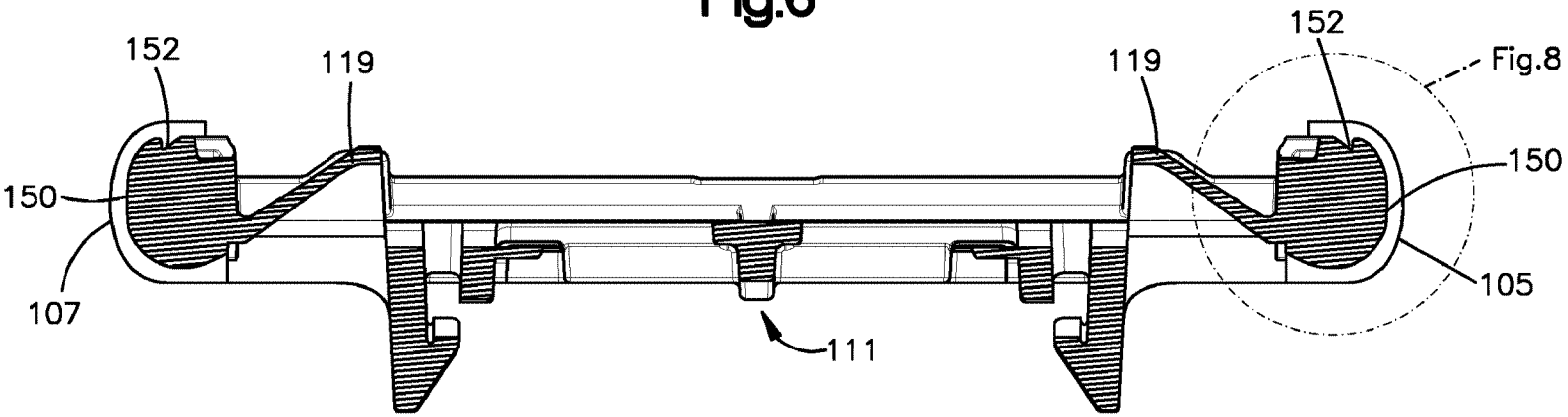
FIG. 7 is a diagram illustrating a cross-sectional view of the shaving cartridge without the retainers along the line B-B shown in FIG. 6.

FIG. 6 is a diagram illustrating a top view of the shaving cartridge 100 without the retainers 200, and FIG. 7 is a diagram illustrating a cross-sectional view of the shaving cartridge 100 without the retainers 200 along the line B-B shown in FIG. 6.

Referring to FIGS. 6-7, as with the retainers 200 described above, the recesses 150 are formed along a portion of the side edges of the housing. The recesses 150 may also be formed along the entire side edges of the housing or along smaller portions of the side edges. Further, the corresponding surface 152 for receiving the protrusion 207 of the retainer 200 may be formed on the upper surface of the recess 150. In this example, the corresponding surface 152 is a triangular recess that is formed on the upper surface of the recess 150. In other examples, the corresponding surface 152 may include a mating surface that is not a recess, or a mating surface that is a recess and has a different shape that corresponds to the shape of the protrusion 207. The springs 119 that are used for supporting the blades 117 may extend from the side of the housing in the region of the recess 150.

Figure 8:
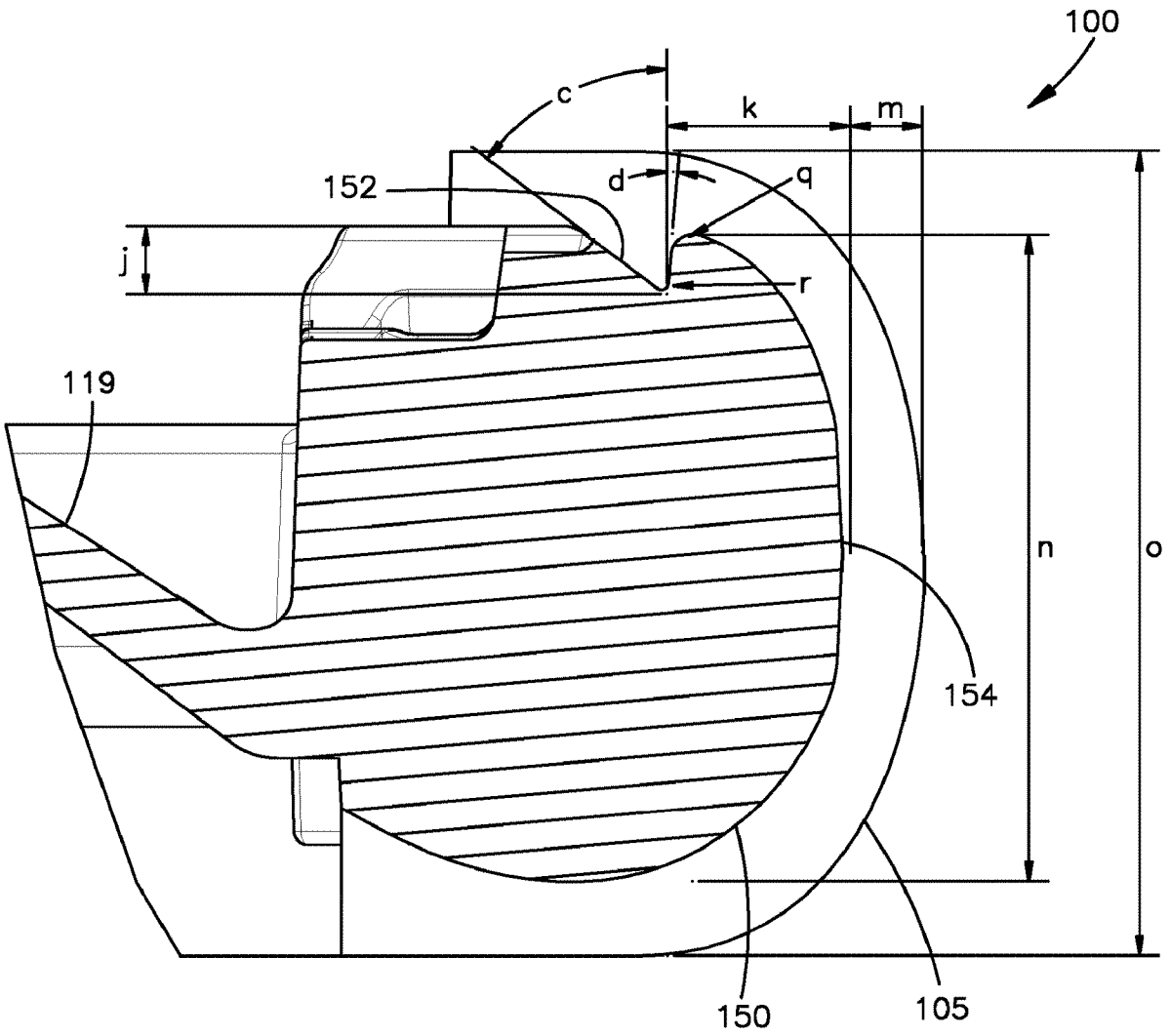
FIG. 8 is a diagram illustrating a magnified cross-sectional view of the shaving cartridge without the retainers in the region shown in FIG. 7.

FIG. 8 is a diagram illustrating a magnified cross-sectional view of the shaving cartridge 100 without the retainers 200 in the region shown in FIG. 7. Referring to FIG. 8, the corresponding surfaces 152 may have a similar shape as the protrusions 207. For example, each corresponding surface 152 has a triangular shape, having an angle that corresponds to the angle c of the protrusion 207, between the left side of the corresponding surface 152 and the vertical line that is passing through the tip of the corresponding surface 152 that is about 55 degrees. The outer side of the corresponding surface 152 and the vertical line that is passing through the tip of the corresponding surface 152 may be at an angle that corresponds to the angle d of the protrusion 207 of is about 5 degrees.

In the example, the wall of the housing at the position of the recess 150 may include a substantially flat surface 154 corresponding to the substantially convex portion 205 of the retainer 200. As a result, an air-gap may exist between the inner surface 217 of the retainer 200 and the parting line area. The flat surface 154 is due to the parting line and an objective to avoid creating a fulcrum effect with the retainer 200. That is, using a curved surface that is in direct contact with the substantially convex portion 205 at the recess 150, rather than the substantially flat surface 154, may create a fulcrum surface that may push the retainer 200 away from the recess 150 and interfere with the secure attachment of the bottom portion 203 with the underside of the housing. Consequently, the recess 150 includes a flat surface 154 for optimal alignment between the retainer 200 and the housing of the razor cartridge 100; however, the razor cartridge 100 of this present invention is not limited to including the substantially flat surface 154. The razor cartridge 100 may include an entirely curved wall at the recess 150, or one or more flat surfaces 154 corresponding to the substantially convex portion 205, top portion 201, or bottom portion 203. An air gap and flat surface 154 may also be applied anywhere that a parting line is designed to ensure the best retainer alignment to the housing.

In this example, the corresponding surface 152 may have a depth j that extends from the top surface of the recess 150 that is approximately 0.4 mm. The distance k from the end of the corresponding surface 152 to the end of the recess 150 may be approximately 1.3 mm. The distance m between the end of the recess 150 and the side edge 105 of the housing where the recess is not formed may be approximately 0.5 mm. The height n of the recess from the uppermost portion to the lowermost portion may be approximately 4.4 mm, and the height o of the side edge 105 of the housing where the recess is not formed may be approximately 5.5 mm. Additionally, the radius of curvature r at the bottom tip of the corresponding surface 152 may be approximately 0.1 mm, and the radius of curvature q at the upper tip of the corresponding surface 152 may be approximately 0.15 mm. It should be appreciated by one of ordinary skill in the art that these dimensions and shapes are only an example of the embodiment, a number of other dimensions and shapes may be used for the recess 150 and the corresponding surface 152.

Figure 9:
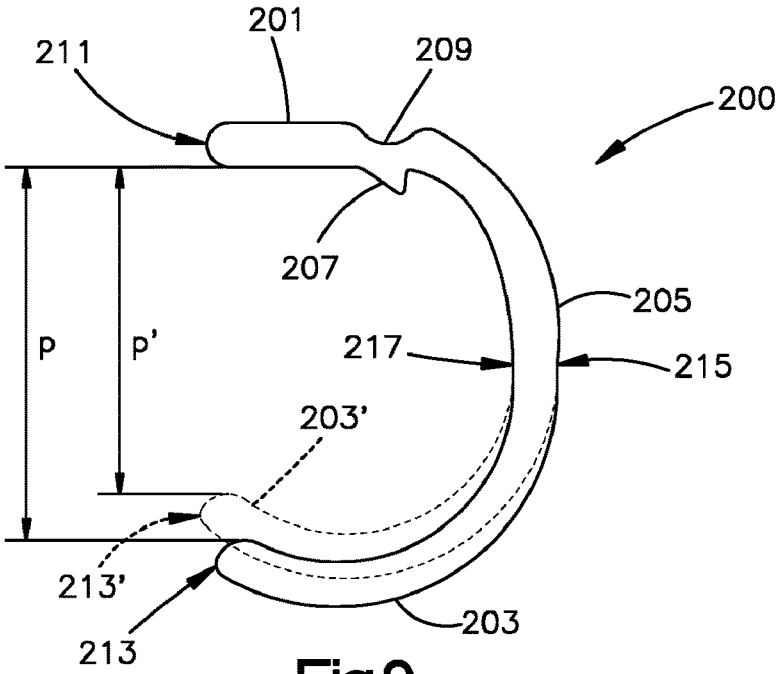
FIG. 9 is a diagram illustrating a side elevation view of an example of a preloaded retainer for securing blades to a razor cartridge as configured prior to being installed and in response to being installed on the razor cartridge.

FIG. 9 is a diagram illustrating a side elevation view of an example of a preloaded retainer for securing blades to a razor cartridge as configured prior to being installed on the razor cartridge 100 and after being installed on the razor cartridge 100.

Referring to FIG. 9, the retainer 200 is a substantially c-shaped retainer and includes a top portion 201, a bottom portion 203, and a substantially convex portion 205 connecting the top portion 201 to the bottom portion 203. In addition, the retainer 200 includes a first face 211 on the top portion 201, a second face 213 on the bottom portion 203, an inner surface 217, and an outer surface 215. The retainer 200 is shown in a configuration prior to being installed on the razor cartridge 100 where the bottom portion 203' is closer to the top portion 200 as compared to the position of the bottom portion 203 after the retainer 200 is installed on the razor cartridge 100. That is, the retainer 200 of this example is a preloaded retainer.

As used in this application, the term "preloaded" hereinafter means having a different configuration, i.e., an installed or final configuration upon completion of an installation process, in response to being installed in the razor cartridge 100 relative to an uninstalled or original configuration before initiating the installation process. In this example, prior to being installed in the razor cartridge 100, the retainer 200 has a smaller configuration where the distance p' from the lowermost part of the top portion 201 adjacent to the first face 211 to the uppermost part of the bottom portion 203' adjacent to the second face 213' is approximately 3.8 mm. In response to being installed in the razor cartridge 100, the bottom portion 203 moves downwardly and the distance p from the lowermost part of the top portion 201 adjacent to the first face 211 to the uppermost part of the bottom portion 203 adjacent to the second face 213 is approximately 4.2 mm. In an example, there is an increase of approximately 10 percent in the distance from the top portion 201 to the bottom portion 203 in response to the retainer 200 being installed in the razor cartridge 100. It should be appreciated by one of ordinary skill in the art that these dimensions and ratios are only an example of the embodiment, and a variety of other dimensions and ratios may be used.

In an embodiment, several functional advantages exist for providing a shaving cartridge 100 with a preloaded retainer 200 having a planar top portion 201 and having a bottom curved portion 203. The planar top portion 201 acts as a blade edge reference that may be in direct contact with the blade edges for securing the blades 117 to the razor cartridge 100. The curved bottom portion 203 more tightly secures the retainer 200 to the razor cartridge 100, and the preloaded retainer 200 allows for an even more secure attachment between the retainer 200 and the razor cartridge 100. Because the retainer 200 expands from its original, at-rest configuration in response to being installed in the razor cartridge 100, a spring force formed as a result of being stretched beyond its at-rest position further secures the retainer 200 to the razor cartridge 100.

Figure 10:
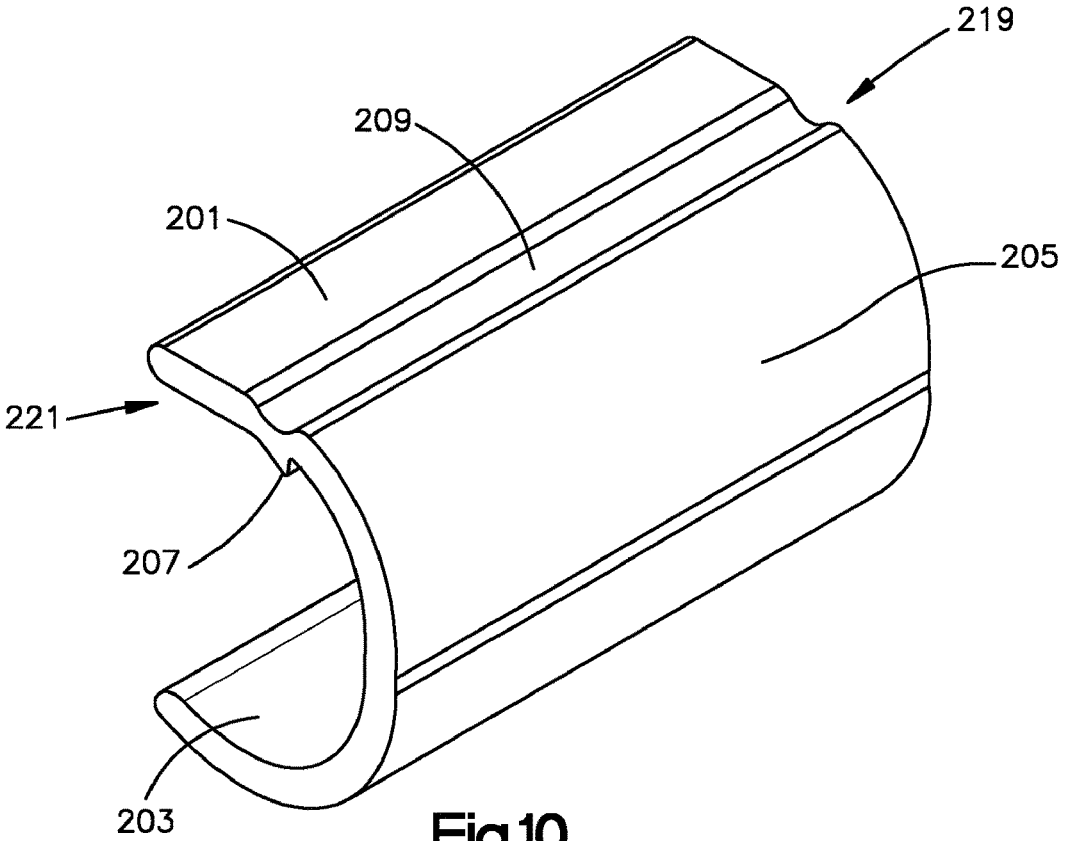
FIG. 10 is a diagram illustrating a perspective view of the retainer.
Figure 11A:
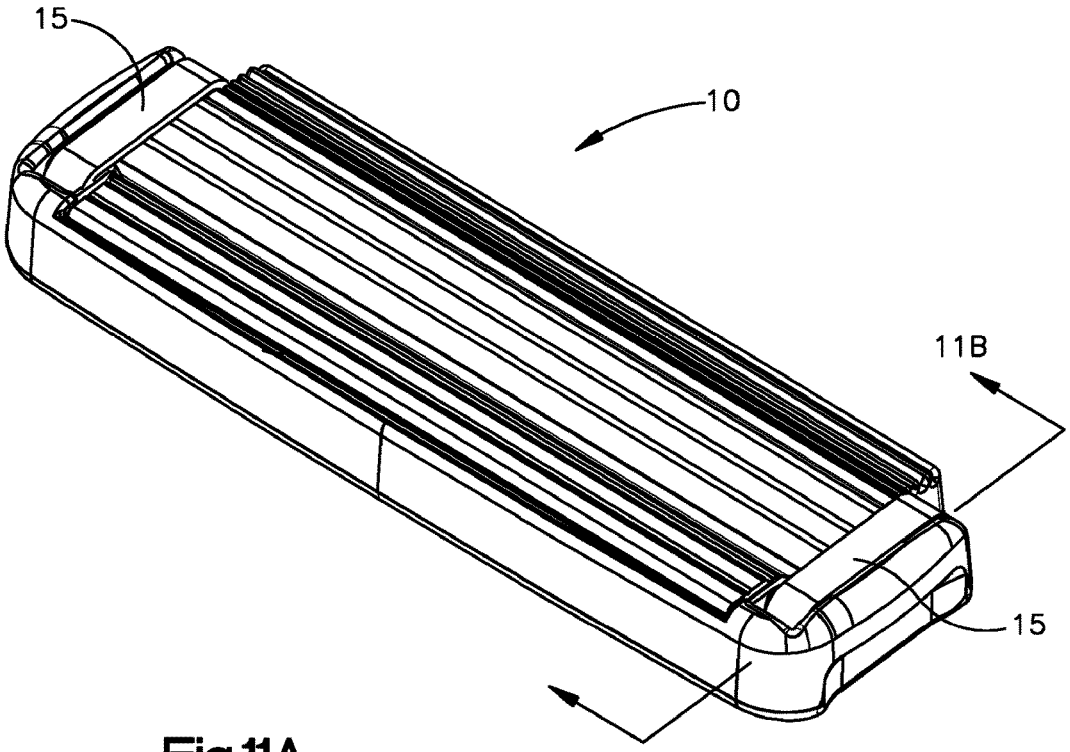
Fig.11A PRIOR ART
FIG. 11A is a diagram illustrating a prior art shaving cartridge.
Figure 11B:
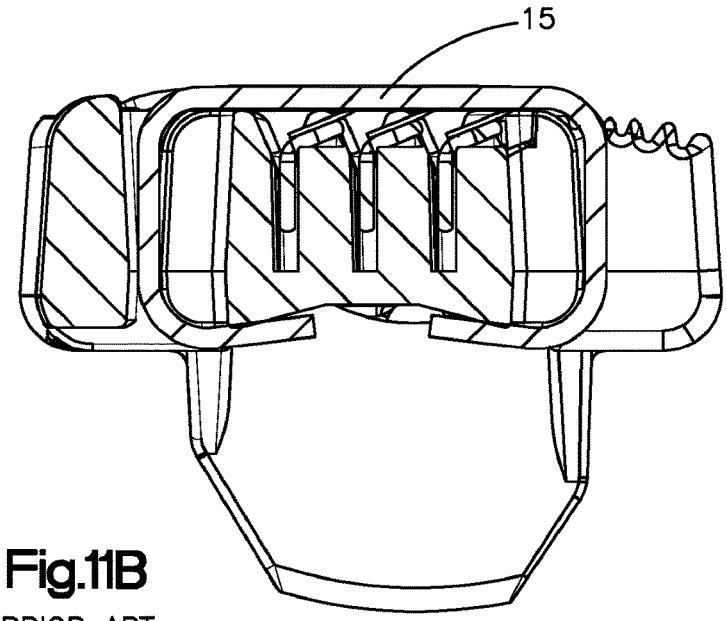
Fig.11B PRIOR ART
FIG. 11B is a diagram illustrating a cross-sectional view of the prior art shaving cartridge.
Figure 12:
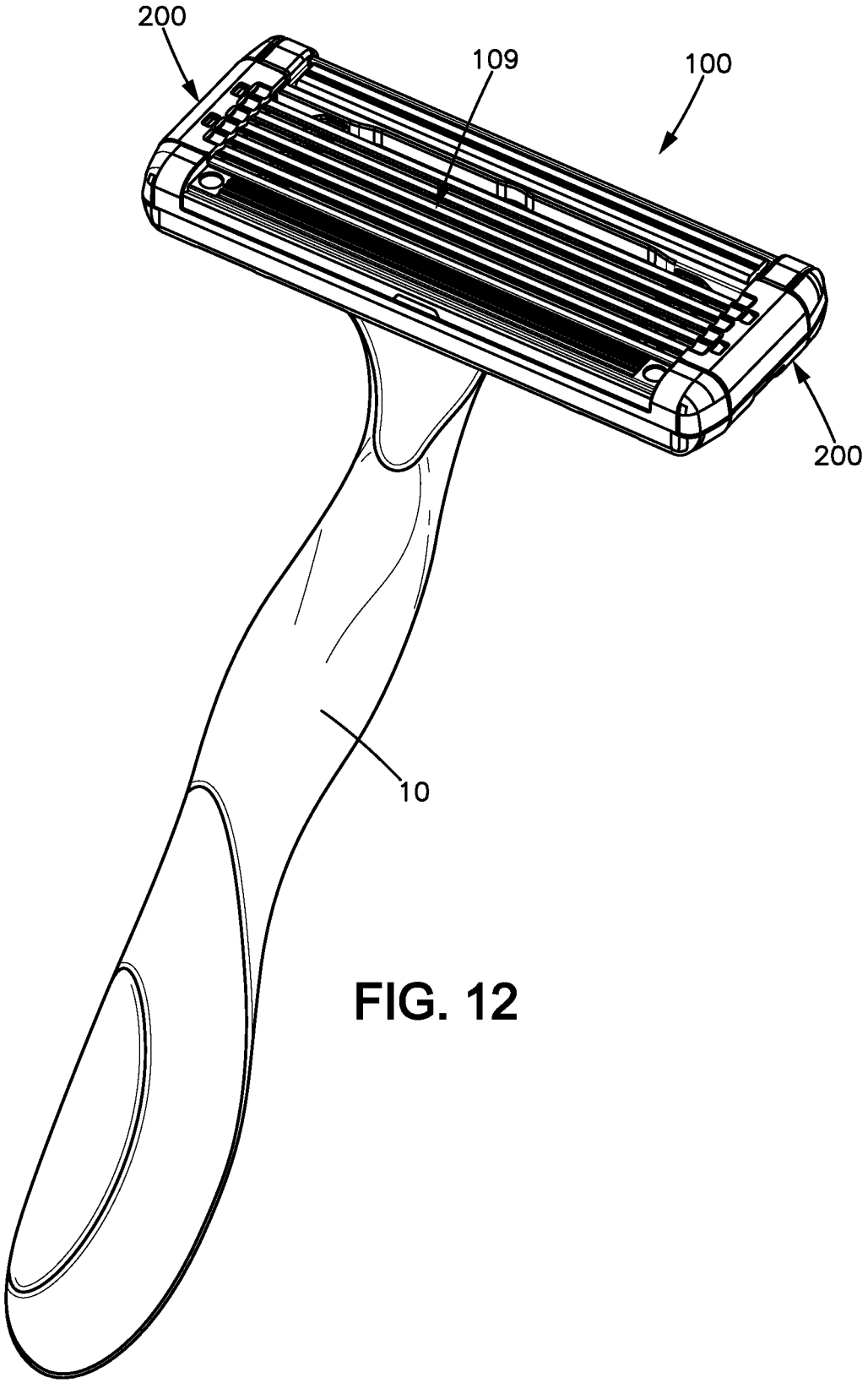

FIG. 10 is a diagram illustrating a perspective view of the retainer 200. Referring to FIG. 10, the retainer 200 includes a recess 209 that is formed on the top portion 201, and a protrusion 207 that extends downwardly from the top portion 201. The retainer 200 includes a front edge 221 that is adjacent to the guard bar 113 when the retainer 200 is secured to the razor cartridge 100, and a rear edge 219 that is adjacent to the cap 115 when the retainer 200 is secured to the razor cartridge 100. The rear edge 219 and the front edge 221 are defined by the top portion 201, the bottom portion 203, and the convex portion 205. Each of the rear edge 219 and the front edge 221 define a single plane, with each of the planes extending parallel to each other, such that the rear edge 219 and the front edge 221 have a constant, equal, linear distance therebetween. In this example, the recess 209 and the protrusion 207 extend along the entire top portion 201 of the retainer 200, from the rear edge 219 to the front edge 221. However, the recess 209 and the protrusion 207 may extend along only a portion of the retainer 200, and more than one recess 209 and protrusion 207 may be formed in different patterns along the top portion 201 of the retainer. Similarly, one or more recesses or protrusions may be formed on the bottom portion 203.

A variety of different benefits, not limited to those described herein, are provided in using the razor cartridge 100 and the retainer 200 compared to conventional clip heads. In an embodiment, the retaining load is applied equally along the entire length of the retainer 200 since the profile of the retainer 200 is the same along its entire length.

In another embodiment, bowing that is typically exhibited with the manufacture of conventional razor heads having the clip design is no longer an issue. Accordingly, a more stable blade edge exposure is attained in using the retainer 200. For example, in a razor cartridge designed to have blade exposures in line with the contact plane, the conventional razor head typically includes blade exposures ranging from 0-0.1 mm above the contact plane. This results from a bowing effect of the clip retaining elements in conventional razor heads. On the other hand, a similarly designed razor cartridge 100 using the retainer 200 may include actual blade exposures ranging from 0-0.06 mm. That is, a razor cartridge 100 using the retainer 200 may exhibit up to 40 percent improved stability in blade edge exposure.

In yet another embodiment, head assembly quality is improved with no possibilities of a clip leg being left unbent under the housing to fix and secure in place. Typically, during the manufacture of a conventional razor head including one or more clip retaining elements for securing blades to a razor cartridge, one or more of the clip retaining elements will remain unbent under the housing and will require further labor to fix and secure the clips in place. In using the razor cartridge 100 and the retainer 200, this manufacturing defect is avoided and head assembly quality is improved.

In an additional embodiment, efficiency of the manufacturing process is significantly improved and manufacturing costs are reduced. In manufacturing a conventional razor head including one or more clip retaining elements, at least a three step process is employed. First, the clip retaining elements are positioned with respect to the housing; second, the clip retaining elements are placed within one or more apertures within the housing; third, the legs of the clip retaining elements are bent and wrapped beneath the housing. Alternatively, for the manufacture of the razor cartridge 100 and the retainer 200, the retainer may be provided and directly fitted to the housing in a single step process. In addition, the materials and dimensions of a clip retaining element typically require a third party manufacturer to provide the clip retaining elements. Alternatively, the larger dimensions and shape of the retainer 200 in accordance with the described embodiments provide for significantly reduced manufacturing costs.

One of skill in the art will recognize that the described examples are not limited to any particular size. Further one of skill in the art will recognize that the components of the retainer 200 are not limited to any type of material. In an example, the retainer 200 is formed of a metal material but may be formed of a variety of different materials including plastic. One skilled in the art will recognize that diameters, types and thicknesses of materials can be utilized when taking into consideration design and stability considerations. A number of manufacturing techniques may be used such as the molding, machining, or casting of any component.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A shaving blade unit comprising:

a housing having (i) a pair of longitudinal sides extending along a longitudinal axis of the housing, (ii) a pair of lateral sides extending between the pair of longitudinal sides, and (iii) at least one blade disposed at least partially within the housing, the at least one blade having a cutting edge extending longitudinally along and parallel with at least a portion of the pair of longitudinal sides; and at least one retainer operable to be selectively and independently secured to any one of the pair of lateral sides of the housing, the at least one retainer including a top portion having an inner surface in direct contact with an upper surface of the at least one blade, a curved bottom portion, the entire length of the curved bottom portion being curved, and a non-planar intermediate portion connecting the top portion to the curved bottom portion, the curved bottom portion and the non-planar intermediate portion forming a continuous curvature, the non-planar intermediate portion being secured to the housing around an outer lateral surface of one of the pair of lateral sides such that the non-planar intermediate portion is curved about an axis that is perpendicular to the longitudinal axis of the housing, and the curved bottom portion being curved around a bottom portion of the one of the pair of lateral sides of the housing.

2. The shaving blade unit of claim 1, wherein, the top portion and the intermediate portion of the at least one retainer include a continuous curvature.

3. The shaving blade unit of claim 1, wherein, the at least one retainer includes (i) a protrusion depending from the top portion, and (ii) a recess extending into the top portion, and the recess and the protrusion are formed on opposite surfaces of the top portion of the at least one retainer.

4. The shaving blade unit of claim 3, wherein, the at least one retainer is a pair of retainers, each of the pair of lateral sides of the housing includes a receiver, and each of the receivers is operable to receive at least a portion of one of the protrusions of a respective one of the pair of retainers.

5. The shaving blade unit of claim 1, wherein, the at least one retainer has a first configuration and a second configuration that is different than the first configuration, the top portion and the bottom portion of the at least one retainer being further apart from each other in the second configuration than in the first configuration.

6. The shaving blade unit of claim 1, wherein, the at least one retainer includes a front edge and a rear edge defined by the top portion, the curved bottom portion, and the intermediate portion, and at least one of the front edge and the rear edge is planar.

7. The shaving blade unit of claim 6, wherein, each of the front edge and the rear edge of the at least one retainer defines a plane, and the planes extend parallel to each other.

8. The shaving blade unit of claim 1, wherein, each of the pair of lateral sides of the housing includes a receiver, and each of the receivers is operable to receive at least a portion of the at least one retainer.

9. The shaving blade unit of claim 1, wherein, the at least one retainer is a pair of retainers that are identical in shape.

10. A shaving blade unit comprising:

a housing having (i) a pair of longitudinal sides extending along a longitudinal axis of the housing, (ii) a pair of lateral sides extending between the pair of longitudinal sides, and (iii) at least one blade disposed at least partially within the housing, and the at least one blade having a cutting edge extending longitudinally along and parallel with at least a portion of the pair of longitudinal sides; and a retainer secured to each of the pair of lateral sides of the housing, each of the retainers having (i) a top portion including an inner surface in direct contact with an upper surface of the at least one blade, (ii) a curved bottom portion, the entire length of the curved bottom portion being curved, (iii) a non-planar intermediate portion connecting the top portion to the curved bottom portion and forming a continuous curvature with the bottom portion, and (iv) planar front and rear edges defined by the top portion, the curved bottom portion, and the intermediate portion;

the intermediate portion being secured to the housing around an outer lateral surface of each one of the pair of lateral sides such that the non-planar intermediate portion is curved about an axis that is perpendicular to the longitudinal axis of the housing.

11. The shaving blade unit of claim 10, wherein, the top portion and the intermediate portion of each of the retainers have a continuous curvature.

12. The shaving blade unit of claim 10, wherein, each of the retainers includes (i) a protrusion depending from the top portion, and (ii) a recess extending into the top portion, and the recess and the protrusion are formed on opposite surfaces of the top portion of each of the retainers.

13. The shaving blade unit of claim 12, wherein, each of the pair of lateral sides of the housing includes a receiver, and each of the receivers is operable to receive at least a portion of one of the protrusions.

14. The shaving blade unit of claim 10, wherein, each of the retainers having a first configuration and a second configuration that is different than the first configuration, the top portion and the bottom portion of each of the retainers being further apart from each other in the second configuration than in the first configuration.

15. The shaving blade unit of claim 10, wherein, each of the pair of lateral sides of the housing includes a receiver, and each of the receivers is operable to receive at least a portion of one of the retainers.

16. The shaving blade unit of claim 10, wherein, the retainers (i) have an identical shape, and (ii) are operable to be selectively and independently secured to any one of the pair of lateral sides.

17. A shaving blade unit comprising:

a housing having (i) a pair of longitudinal sides extending along a longitudinal axis of the housing, (ii) a pair of lateral sides extending between the pair of longitudinal sides, and (iii) at least one blade disposed at least partially within the housing, the at least one blade having a cutting edge extending longitudinally along and parallel with at least a portion of the pair of longitudinal sides; and a pair of retainers secured to the housing, each of the retainers (i) secured to one of the pair of lateral sides of the housing, (ii) having an identical shape, (iii) operable to be independently secured to either one of the pair of lateral sides, and (iv) including at least a top portion including an inner surface in direct contact with an upper portion of the at least one blade, a substantially non-planar intermediate portion, and a curved bottom portion forming a substantially continuous curvature, wherein the substantially non-planar intermediate portion extends along and corresponds to an outer lateral surface of a respective one of the pair of lateral sides such that the non-planar intermediate portion is curved about an axis that is perpendicular to the longitudinal axis of the housing, wherein the entire length of the curved bottom portion is curved.

18. The shaving blade unit of claim 17, wherein, for each of the retainers, the intermediate portion connecting the top portion to the curved bottom portion, the top portion and the intermediate portion of each of the retainers having a substantially continuous curvature.

19. The shaving blade unit of claim 17, wherein, for each of the retainers, the intermediate portion connecting the top portion to the curved bottom portion, the top portion including (i) a protrusion depending therefrom, and (ii) a recess extending into the top portion, and the recess and the protrusion are formed on opposite surfaces of the top portion of each of the retainers.

20. The shaving blade unit of claim 19, wherein, each of the pair of lateral sides of the housing includes a receiver, and each of the receivers is operable to receive at least a portion of one of the protrusions.

21. The shaving blade unit of claim 17,
wherein,
for each of the retainers, the intermediate portion connecting the top portion to the curved bottom portion, and a front edge and a rear edge defined by the top portion, the curved bottom portion, and the intermediate portion, and
at least one of the front edge and the rear edge is planar.

22. The shaving blade unit of claim 21,
wherein,
each of the front edge and the rear edge of each of the retainers defines a plane, and
the planes extend parallel to each other.

23. The shaving blade unit of claim 17,
wherein,
each of the pair of lateral sides of the housing includes a receiver, and
each of the receivers is operable to receive at least a portion of one of the retainers.

* * * * *